US005400718A

United States Patent [19]

Theurer et al.

[11] Patent Number: 5,400,718

[45] Date of Patent: Mar. 28, 1995

[54] LOADING WAGON FOR TRANSPORT, STORAGE AND DISCHARGE OF BULK MATERIAL

[75] Inventors: Josef Theurer, Wien; Manfred Brunninger, Altenberg, both of Austria

[73] Assignee: Franz Plasser Bahnbaumaschinin-Industriegesellschaft, Wien, Austria

[21] Appl. No.: 152,046

[22] Filed: Nov. 12, 1993

[30] Foreign Application Priority Data

Nov. 18, 1992 [AT] Austria ..... 2294/92
Dec. 16, 1992 [AT] Austria ..... 2494/92

[51] Int. Cl.[6] ..... B65G 67/00

[52] U.S. Cl. ..... 105/239; 104/2; 105/238.1; 105/280; 105/250; 105/252; 414/502; 414/528

[58] Field of Search ..... 105/239, 247, 248, 311.1, 105/238.1, 250, 251, 252, 280; 104/2; 414/339, 502, 528, 519, 520; 37/107; 198/371

[56] References Cited

U.S. PATENT DOCUMENTS 4,809,617 3/1989 Theurer et al. ..... 105/239
4,958,573 9/1990 Mancini ..... 104/2
5,094,018 3/1992 Theurer et al. ..... 104/2
5,201,127 4/1993 Whitaker ..... 104/2

FOREIGN PATENT DOCUMENTS 2264275 8/1993 United Kingdom ..... 104/2

*Primary Examiner*—Mark T. Le
*Attorney, Agent, or Firm*—Meltzer, Lippe, Goldstein et al.

[57] ABSTRACT

A loading wagon (1) for the transport, storage and discharge of bulk material has a wagon frame (2) supported on on-track undercarriages (3) and a wagon body (5) connected to the wagon frame, there being arranged in the base region of the wagon body a base conveyor belt (7) having a drive (11). Provided adjacent thereto is a transfer conveyor belt (8) which projects over the end of the wagon frame, has an elevated discharge end (9) with respect to the wagon frame (2), and which is provided with a drive (12), with a storing or transporting direction (31) running from the base conveyor belt (7) to the transfer conveyor belt (8). An outlet opening (14) for discharging the bulk material onto the track is provided beneath the base conveyor belt (7). The drive (11) for the base conveyor belt (7) or the transfer conveyor belt (8) is designed for selective operation in the first transporting direction or in a second transporting direction running in the opposite direction thereto.

12 Claims, 1 Drawing Sheet

LOADING WAGON FOR TRANSPORT, STORAGE AND DISCHARGE OF BULK MATERIAL

BACKGROUND OF THE INVENTION

The invention relates to a loading wagon for the transport, storage and discharge of bulk material, comprising a wagon frame supported on on-track undercarriages and a wagon body connected to the wagon frame, there being provided in the base region of the wagon body a base conveyor belt having a drive with a transfer conveyor belt which projects over the end of the wagon frame, has an elevated discharge end with respect to the wagon frame, and which is provided with a drive, with a storing or transporting direction running from the base conveyor belt to the transfer conveyor belt, and comprising an outlet opening for discharging the bulk material on to the track.

A loading wagon of this kind which is movable on a track by means of on-track undercarriages is already known from U.S. Pat. No. 4,809,617, this being predominantly used in track maintenance operations. In order to transport and store fairly large amounts of bulk material, several of these loading wagons are preferably combined to form a loading train, a continuous conveyor belt path being formed by means of the mutually overlapping conveyor devices. This enables the individual wagon bodies of the whole train to be loaded and unloaded quickly and above all automatically. It also enables bulk material, such as spoil from a track bed cleaning machine for instance, to be transported through in a simple manner. The conveyor device is composed of a base conveyor belt arranged in the base of the wagon body and a transfer conveyor belt following it in the transporting direction. The known loading wagon may also be used for ballasting a track and is provided for this purpose with a discharge device having a chute-like outlet opening. This discharge device is arranged at the front end of the loading wagon—with respect to the transporting direction—and in one form of construction is designed as a self-propelling individual vehicle or as a discharging wagon which is coupled with the bulk material loading wagon when required and the discharge chutes of which are supplied with ballast by way of the conveyor device. In a different variant (FIGS. 4 and 5), the discharge device is secured directly to the wagon frame immediately preceding the wagon body, outlet openings being situated on either side of the conveyor device. A V-shaped deflecting element which is vertically adjustable by means of a hydraulic drive is provided in this area immediately above the conveyor device, in order in its lowered position to deflect the ballast transported on the conveyor device to the left and right into the outlet openings or discharge chutes and to discharge it into the track bed. However, this known design is disadvantageous particularly in track curves, as in these the transfer conveyor belt is displaced with respect to the outlet openings.

The object underlying the invention is to improve a loading wagon of the type specified in the introduction to the effect so that, with a constructionally simplified design of the wagon, the discharging of bulk material onto the track in precisely measured amounts and in a controlled manner may take place.

SUMMARY OF THE INVENTION

This object underlying the invention is achieved with a loading wagon of the type previously defined in that the outlet opening is provided beneath the base conveyor belt and the drive for the base conveyor belt or the transfer conveyor belt is designed for selective operation in a first transporting direction or in a second transporting direction running in the opposite direction thereto.

An arrangement of this kind of the outlet opening means that the loading wagon can be used at any time and without specific measures, such as the lowering of a deflecting device for example, for the directed discharge of the stored bulk material onto the track. To achieve this, it is merely necessary to operate the drive of the base or transfer conveyor belt not in the first transporting direction but in a second transporting direction running in the opposite direction thereto. The ability of the loading wagon to be used for the transport and storage of bulk material, more particularly its advantageous automatic loading and unloading facility because the transfer conveyor belt has an elevated end and a lower end, is not thereby restricted in the least as the outlet opening is bridged by the conveyor device. The loading wagon may thus remain in the train formation without any problem and may be used for the directed discharge of bulk material, such as ballast for example, in specific areas of track. The four discharge openings of the discharge chute, arranged side by side in the transverse direction of the track, combined with the width of the outlet opening which is adapted to the width of the conveyor device, ensure the exact distribution of the quantity of bulk material according to the requirements on the right or left of each rail, the amount to be discharged being controllable very simply by the speed of the conveyor device and by a pivotable control flap arranged centrally in the discharge chute. The pivotable discharge flaps provided in addition to the chutes mean that fairly large amounts of ballast can also be made to flow towards the track shoulders, as the case requires. The design according to the invention is also suitable, in a particularly advantageous manner, for use with loading wagons which are already in service, as the particular location of the outlet opening at the end of the wagon frame means that no constructional alterations of any kind to the conveyor device nor expensive conversion work on the loading wagon need be undertaken.

The invention also comprises a method of conveying and discharging bulk material onto a track. In the event of an increased ballast requirement, such as when re-ballasting a fairly long stretch of track, after the emptying of the whole storage volume of the wagon body of the front loading wagon, in the transporting direction, of a transport train, the flow of ballast through the following loading wagons may thus be maintained by way of the continuous conveyor belt path. The drive of the conveyor device of this front loading wagon is in this case continually operated in a second transporting direction which runs counter to the first transporting direction of the transport train, while the transport train advances continuously along the track.

BRIEF DESCRIPTION OF THE DRAWINGS

Two embodiments of the invention are represented in the drawings, in which.

DETAILED DESCRIPTION OF PREFERRED EMBODIMENTS

Figure 1:
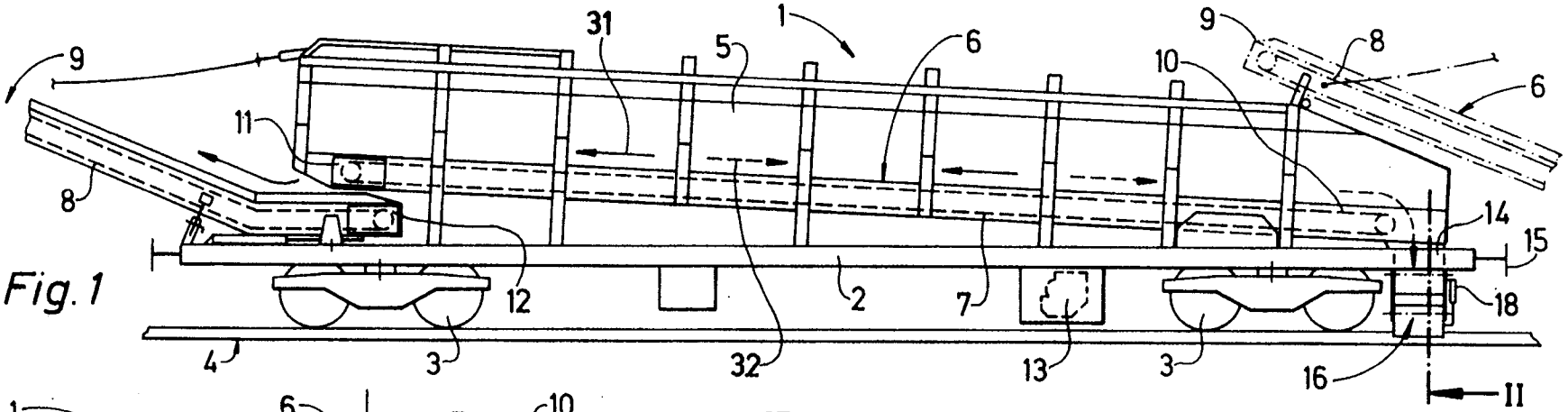
FIG. 1 shows a side view of a loading wagon designed in accordance with the invention.

A loading wagon 1 represented in FIG. 1 has a wagon frame 2 which is supported on on-track undercarriages 3 and is movable on a track 4. Secured to the wagon frame 2 is a wagon body 5 with which a conveyor device 6 is associated for the purpose of transporting, storing and discharging bulk material. This conveyor device consists of a base conveyor belt 7, running in the base region of the wagon body 5 and extending over the entire length thereof, and a transfer conveyor belt 8 which adjoins the end of the base conveyor belt 7 and is mounted on the wagon frame 2 for pivoting about a vertical axis. A free pivotable end 9 of this transfer conveyor belt 8 projects over the end of the wagon frame and is arranged so as to be elevated with respect to the wagon frame 2, while the opposite end 10 of the conveyor device 6 (or of the base conveyor belt 7) which is remote therefrom in the longitudinal direction of the wagon is arranged in a lower position in comparison with free end 9. The two conveyor belts 7, 8 are equipped with their own drives 11 and 12 respectively, these being supplied with energy by way of a power source 13. The conveyor device 6 is operated for storing and transporting bulk material by means of the drives 11 and 12 in a first transporting direction 31—indicated by small arrows—which runs from the lower end 10 to the elevated end 9. In addition, the drive 11 of the base conveyor belt 7 is also operable if desired in a second transporting direction 32 (see broken arrows) which runs counter to the first transporting direction 31, in order to convey the bulk material to an outlet opening 14 located immediately beneath the lower end 10 of the conveyor device 6.

Figure 2:
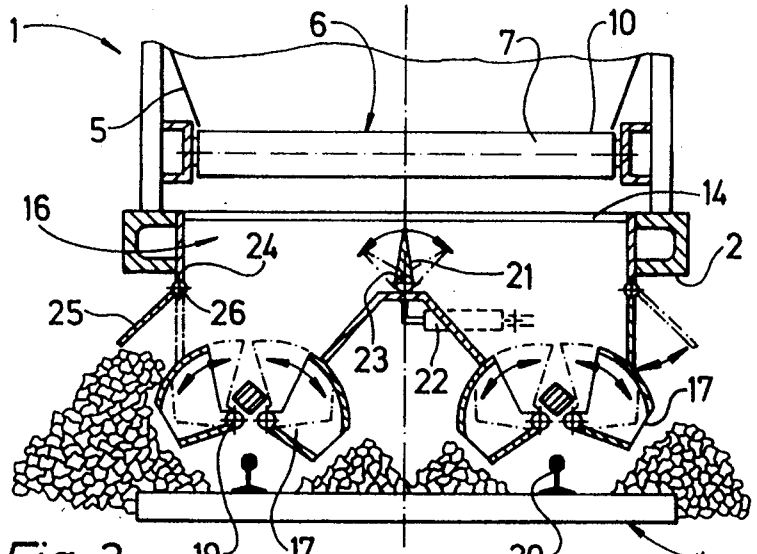
FIG. 2 shows a section in the transverse direction of the wagon in the direction of the arrow II in FIG. 1.

As FIG. 2 now shows, the outlet opening 14 is designed for discharging bulk material onto the track 4 and in its width extending perpendicularly to the longitudinal direction of the wagon approximately corresponds to the width of the conveyor device 6 or of the base conveyor belt 7. The outlet opening 14 is arranged, with respect to the longitudinal direction of the wagon, within the wagon body 5 between the lower end 10 of the conveyor device 6 and a coupling- and/or buffer device 15 provided on the end of the wagon frame 2. Associated with the outlet opening 14 is a discharge chute 16 which has four discharge openings 17 situated side by side in the transverse direction of the wagon. These are designed so as to be controllable and are in each case rotatable by means of a pivot drive 18 (FIG. 1) about an axis 19 aligned in the longitudinal direction of the wagon, in order to discharge the bulk material in a directed manner right or left of a rail 20 of the track 4. A control flap 21 arranged centrally with respect to the transverse direction of the wagon is pivotable by means of a drive 22 about an axis 23 extending in the longitudinal direction of the wagon and controls the proportional distribution of the flow of bulk material coming from the base conveyor belt 7 towards one or other rail 20.

The discharge chute 16 is limited on the two longitudinal sides of the wagon by vertical side walls 24 oriented parallel to the longitudinal direction of the wagon. The lower portion of these side walls 24, respectively adjoining the outer discharge openings 17 with respect to the transverse direction of the track, is designed as a discharge flap 25 which is pivotable about an axis 26 extending in the longitudinal direction of the wagon, and in the opened position thereof bulk material may be discharged towards the track shoulder areas.

Figure 3:
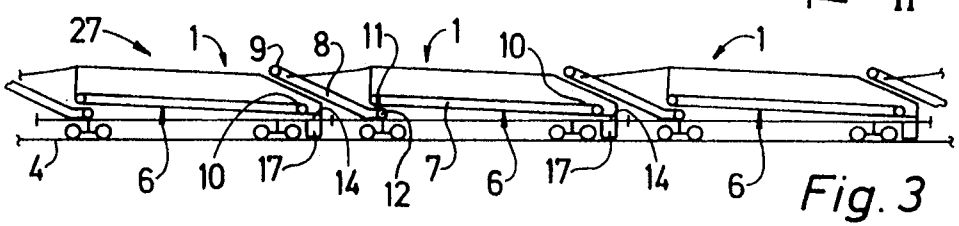
FIG. 3 shows a greatly schematized side view of a transport train formed from several loading wagons.

As is now shown clearly in FIG. 3, the loading wagon 1—because of its design with a projecting elevated end 9 and a lower end 10 of the conveyor device 6—may be coupled with other loading wagons of the same kind to form a transport train 27 in which the conveyor devices 6 of the individual loading wagons mutually overlap at the ends and form a continuous transport path. In this position, the outlet opening 14 of each loading wagon is situated so as to be remote in the longitudinal direction of the wagon from the elevated end 9 of the transfer conveyor belt 8 of the conveyor device 6 of the loading wagon which follows with respect to the first transporting direction 31 and which adjoins in the normal coupling position, and is bridged by this conveyor device (see also the position of the conveyor device 6 shown in dot and dash lines, on the right of FIG. 1). The emptying of the bulk material stored in a loading wagon 1 or the further transportation thereof into a loading wagon of the same kind which precedes it—in the first transporting direction 31—thus occurs over the outlet opening 14. When a whole transport train 27 is unloaded, for instance when re-ballasting a previously excavated track bed, the drive 11 of the base conveyor belt 7 of the front loading wagon 1, with respect to the first transporting direction 31, is operated in the opposite direction or second transporting direction 32 and the bulk material contained in this loading wagon is discharged into the track 4 via the outlet opening 14 and the discharge openings 17. The respective loading wagon 1 of the transport train 27 which follows in the first transporting direction 31 is then emptied by way of the respective conveyor device(s) 6 into the front loading wagon 1 and is discharged again therefrom in the second transporting direction 32 by way of the outlet opening 14. The loading wagons 1 combined to form the transport train 27 are meanwhile moved continuously along the track 4 by means of a train locomotive which is not represented specifically.

Figure 4:
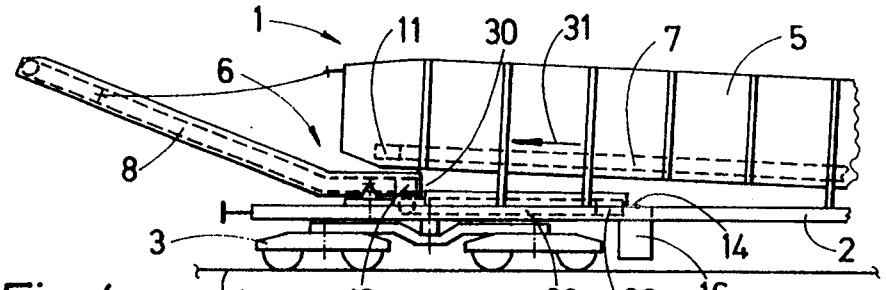
FIG. 4 shows a simplified partial side view of another variant of a loading wagon according to the invention.

For the sake of greater clarity, only part of another variant of a loading wagon 1 according to the invention is represented in FIG. 4. In the basic construction this is similar to the loading wagon shown in FIG. 1, and for the sake of simplicity the same components also bear the same reference numerals as in FIG. 1. Arranged on the loading wagon 1 in this case is an additional conveyor belt 28 having a drive 29 and running in the longitudinal direction of the wagon. The input end 30 of the conveyor belt 28 is situated beneath the rear, in the first transporting direction 31, or lower end of the transfer conveyor belt 8. The conveyor belt 28 runs beneath the wagon body 5 and ends above the outlet opening 14 designed as a discharge chute 16. This outlet opening is arranged between the two on-track undercarriages 3, immediately following the front on-track undercarriage 3 in the transporting direction 31. In order to ballast the tamping bearing surfaces, ballast is transported in the first transporting direction 31 by means of the base conveyor belt 7. The ballast is discharged therefrom onto the transfer conveyor belt 8 which is running in the opposite direction to the transporting direction 31 and is passed along to the input end 30 of the conveyor belt 28. Finally, the ballast is discharged from the conveyor belt 28 into the outlet opening 14 and from this into the track area.

While the invention has been described by reference to specific embodiments, this was for purposes of illustration only. Numerous alternative embodiments will be apparent to those skilled in the art and are considered to be within the scope of this invention.

We claim:

1. A railway loading wagon for the transport, storage and discharge of bulk material along a railway track, comprising a wagon frame supported on the track by on-track undercarriages, a wagon body having a base region connected to said wagon frame, a base conveyor belt in the base region of said wagon body, a transfer conveyor belt which projects over an end of said wagon frame, said transfer conveyor belt having a discharge end which is elevated with respect to said wagon frame, an outlet opening beneath said base conveyor belt for discharging the bulk material onto the track, and first and second drive units associated with said base conveyor belt and said transfer conveyor belt, said first and second drive units being actuable to selectively operate each of said base conveyor belt and said transfer conveyor belt in a first transporting direction and in a second transporting direction which is opposite to said first transporting direction.

2. The railway loading wagon of claim 1 wherein said base conveyor belt has a width and said outlet opening has a width extending perpendicularly to a longitudinal direction of said wagon which corresponds to said width of said base conveyor belt.

3. The railway loading wagon of claim 1 wherein said outlet opening is located within said wagon body.

4. A railway loading train comprising at least first and second railway loading wagons in accordance with claim 1 coupled together, said first railway wagon preceding said second railway wagon with respect to said first transporting direction, wherein said outlet opening of said first loading wagon is situated to be bridged by said transfer conveyor belt of said second railway loading wagon and remote from said discharge end of said transfer conveyor belt of said second railway loading wagon.

5. The railway loading wagon of claim 1 further comprising a discharge chute associated with said outlet opening, said discharge chute including a plurality of discharge openings arranged side by side in a transverse direction of said loading wagon.

6. The railway loading wagon of claim 5 wherein said discharge chute has vertical side walls extending in a longitudinal direction of said loading wagon, said side walls including lower portions adjoining outer ones of said discharge openings, said lower portions comprising discharge flaps pivotable about longitudinal axes.

7. The railway loading wagon of claim 5 further comprising a control flap associated with said discharge chute, said control flap being arranged centrally with respect to said transverse direction of said loading wagon, and being pivotable about an axis extending in a longitudinal direction of said loading wagon.

8. The railway loading wagon of claim 1 wherein said outlet opening is situated between an end of said base conveyor belt which is remote from said transfer conveyor belt and a coupling/buffer device located on an end of said wagon frame.

9. The railway loading wagon of claim 1 further comprising a third conveyor belt situated between a lower end of said transfer conveyor belt and said outlet opening, said third conveyor belt having a front end located beneath said lower end of said transfer conveyor belt, and a third drive unit associated with said third conveyor belt, said third drive unit being actuable to operate said third conveyor belt in said second transporting direction.

10. The railway loading wagon of claim 9 further comprising an additional on-track undercarriage, said outlet opening being located between two of said on-track undercarriages.

11. The railway loading wagon of claim 10 wherein said outlet opening is located immediately after the front on-track undercarriage with respect to the first transporting direction.

12. A method of conveying and discharging bulk material onto a railway track by a transport train comprising a plurality of railway loading wagons in accordance with claim 1 coupled together, said method comprising causing said transfer conveyor belt of a first of said railway loading wagons to operate in said first transporting direction to empty bulk material stored therein into a second of said railway loading wagons which precedes said first railway loading wagon with respect to said first transporting direction, causing said base conveyor belt of said second railway loading wagon to operate in said second transporting direction, thereby causing said bulk material to be discharged through said outlet opening of said second railway wagon, and continuously advancing said loading train along said track.

* * * * *